US008066516B2

(12) United States Patent
Hoshiba et al.

(10) Patent No.: US 8,066,516 B2
(45) Date of Patent: Nov. 29, 2011

(54) COAXIAL CONNECTOR

(75) Inventors: Hiroyuki Hoshiba, Ishikawa-ken (JP); Chikara Uratani, Ishikawa-ken (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 12/692,292

(22) Filed: Jan. 22, 2010

(65) Prior Publication Data

US 2010/0130028 A1 May 27, 2010

Related U.S. Application Data

(63) Continuation of application No. PCT/JP2009/054632, filed on Mar. 11, 2009.

(30) Foreign Application Priority Data

Jun. 25, 2008 (JP) ..... 2008-165468

(51) Int. Cl.
*H01R 12/00* (2006.01)

(52) U.S. Cl. ..... 439/63; 439/944

(58) Field of Classification Search ..... 439/63, 439/246, 188, 944, 581
See application file for complete search history.

(56) References Cited

U.S. PATENT DOCUMENTS 6,068,492 A 5/2000 Uratani et al.
6,808,405 B1 * 10/2004 Uratani et al. ..... 439/188
7,726,992 B2 * 6/2010 Wang et al. ..... 439/188
2001/0050983 A1 * 12/2001 Shima et al. ..... 379/188
2002/0034890 A1 * 3/2002 Uratani ..... 439/188

FOREIGN PATENT DOCUMENTS

JP 2001-338737 A 12/2001
JP 2002-352924 A 12/2002
JP 2005-302530 A 10/2005
JP 3142192 U 5/2008
KR 10-1999-0067869 A 8/1999

OTHER PUBLICATIONS

International Search Report; PCT/JP2009/054632; Jun. 2, 2009.
Examination results from the Korean Intellectual Property Office dated Jun. 15, 2010.

* cited by examiner

*Primary Examiner* — Tulsidas C Patel
*Assistant Examiner* — Travis Chambers
(74) *Attorney, Agent, or Firm* — Studebaker & Brackett PC; Tim L. Brackett, Jr.

(57) ABSTRACT

There is provided a coaxial connector having a good radio-frequency characteristic includes a main body having a hole, or opening for allowing a probe to be inserted, a fixed terminal is fixed to the main body, a movable terminal including a fixed portion fixed to the main body and a plate spring portion extending from the fixed portion toward the fixed terminal. The plate spring portion is in contact with the fixed terminal and in contact with the main body at its tips. The plate spring portion can be displaced by the probe in a direction away from the fixed terminal.

19 Claims, 9 Drawing Sheets

FIG. 4
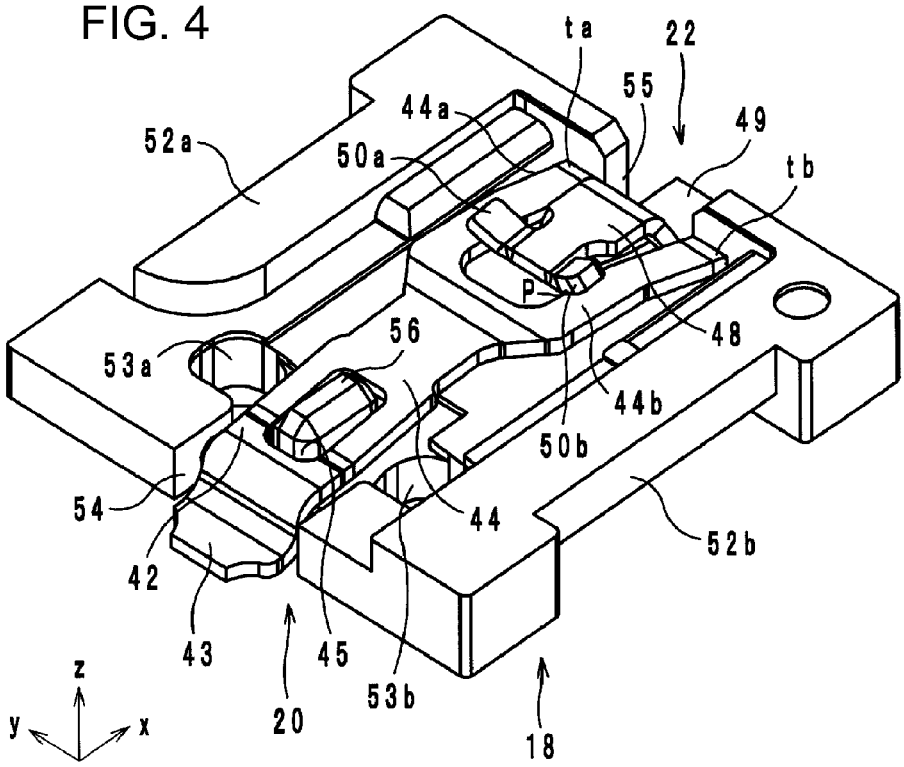
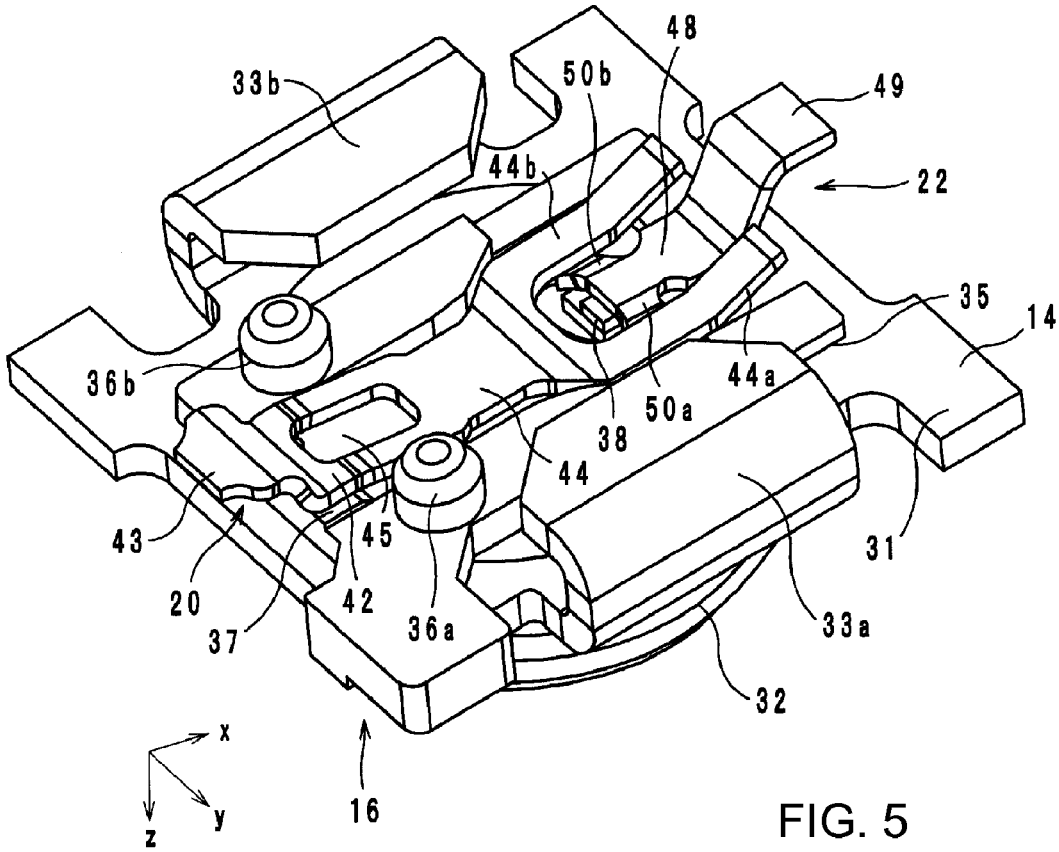
FIG. 5

COAXIAL CONNECTOR

CROSS REFERENCE TO RELATED APPLICATIONS

The present application is a continuation of International Application No. PCT/JP2009/054632, filed Mar. 11, 2009, which claims priority to Japanese Patent Application No. JP 2008-165468, filed Jun. 25, 2008, the entire contents of each of these applications being incorporated herein by reference in their entirety.

BACKGROUND

1. Technical Field

The invention relates to coaxial connectors that switch a signal path, such as a connector embedded in a mobile communication device.

2. Description of the Related Art

Japanese Unexamined Patent Application Publication No. 2002-42991 ("the '991 application") describes a traditional coaxial connector. That coaxial connector is described below with reference to FIGS. 10 and 11 of the drawings. FIG. 10 shows a cross-sectional structure of a coaxial connector 110 described in the '991 application. FIG. 11 is an external perspective view that shows a casing 118, a movable terminal 120, and a fixed terminal 122 of the coaxial connector 110. In FIGS. 10 and 11, the z-direction is a direction in which an external terminal 114, a casing 116, and the casing 118 are placed. The x-direction is a direction in which the movable terminal 120 and the fixed terminal 122 are arranged. The y-direction is a direction perpendicular to the x-direction and the z-direction.

As shown in FIG. 10A, the coaxial connector 110 includes a main body 112, the movable terminal 120, and the fixed terminal 122. The main body 112 is made up of the external terminal 114 and the casings 116 and 118.

As shown in FIG. 11, the movable terminal 120 and the fixed terminal 122 are attached on the casing 118. The fixed terminal 122 is attached in the positive x-direction and includes a fixing portion 148 and a contact portion 150. As shown in FIG. 10A, the fixing portion 148 is disposed between the casing 116 and the casing 118 and fixes the fixed terminal 122 to the main body 112. The contact portion 150 protrudes from the fixing portion 148 in the negative x-direction.

The movable terminal 120 is attached in the negative x-direction and includes a fixing portion 142, a plate spring portion 144, and a contact portion 146. As shown in FIG. 10A, the fixing portion 142 is positioned between the casing 116 and the casing 118 and fixes the movable terminal 120 to the main body 112. The plate spring portion 144 extends in the y-direction and is in contact with the casing 118 at its both ends. In addition, the plate spring portion 144 has a shape that is curved so as to protrude in the positive z-direction. The contact portion 146 protrudes from the central part of the plate spring portion 144 in the y-direction to the positive x-direction and is pressed in contact with the contact portion 150 by an urging force of the plate spring portion 144.

The coaxial connector 110 having the above-described structure is provided, for example, between an antenna and a transmitter-receiver circuit of a cellular phone. Specifically, the fixed terminal 122 is connected to the antenna, and the movable terminal 120 is connected to the transmitter-receiver circuit. Typically, the movable terminal 120 and the fixed terminal 122 are in contact with each other, so the antenna and the transmitter-receiver circuit are connected to each other.

Meanwhile, to measure electric characteristics of a transmitter-receiver circuit of a cellular phone by a cellar phone manufacturer, as shown in FIG. 10B, a probe 130 connected to a measuring device is inserted into the main body 112 from the positive to negative z-direction. Then, the probe 130 presses the plate spring portion 144 down, and this separates the contact portion 146 and the contact portion 150 from each other. As a result, the probe 130 and the movable terminal 120 become connected to each other, and the transmitter-receiver circuit and the measuring device become connected to each other.

Incidentally, for the coaxial connector 110, as shown in FIG. 11, the plate spring portion 144 extends in the y-direction. In order to exhibit an appropriate elastic force, the plate spring portion 144 needs to have a sufficient length in the y-direction. Because of this, in a signal path formed by the movable terminal 120 and the fixed terminal 122, the plate spring portion 144 is wider than other sections (e.g., the fixing portions 142 and 148). As such, when the plate spring portion 144 is wider than other sections, impedance matching in the plate spring portion 144 is undone. As a result, a radio-frequency characteristic of the coaxial connector 110 deteriorates.

SUMMARY

To overcome the problems described above, embodiments in accordance with the invention provide a coaxial connector having a good radio-frequency characteristic.

A coaxial connector according to an embodiment includes a main body that has an opening allowing a probe to be inserted therein, a fixed terminal fixed to the main body, and a movable terminal that includes a movable-terminal fixed portion fixed to the main body and a plate spring portion extending from the movable-terminal fixed portion toward the fixed terminal. The plate spring portion is in contact with the fixed terminal and in contact with the main body at a tip thereof. The plate spring portion can be displaced by the probe in a direction away from the fixed terminal.

With the present invention, the plate spring portion extends from the fixed portion of the movable-terminal toward the fixed terminal. Therefore, it is easy to achieve impedance matching in the coaxial connector, and the coaxial connector having a good radio-frequency characteristic is obtainable.

BRIEF DESCRIPTION OF THE DRAWINGS

FIG. 4 is an external perspective view generally from the top side of a portion of a coaxial connector showing a state in which a movable terminal and a fixed terminal are attached on a lower casing.

FIG. 5 is an external perspective view generally from the bottom side of a portion of a coaxial connector showing a state in which the movable terminal and the fixed terminal are attached on an upper casing.

DETAILED DESCRIPTION

A coaxial connector according to exemplary embodiments is described below with reference to the drawings.

Figure 1A:
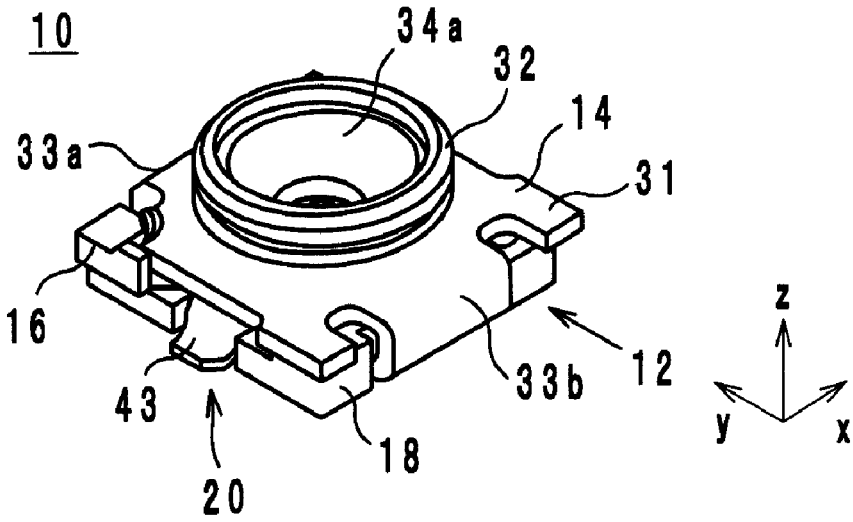
FIG. 1A is an external perspective view generally from the top of a coaxial connector according to an exemplary embodiment.
Figure 2:
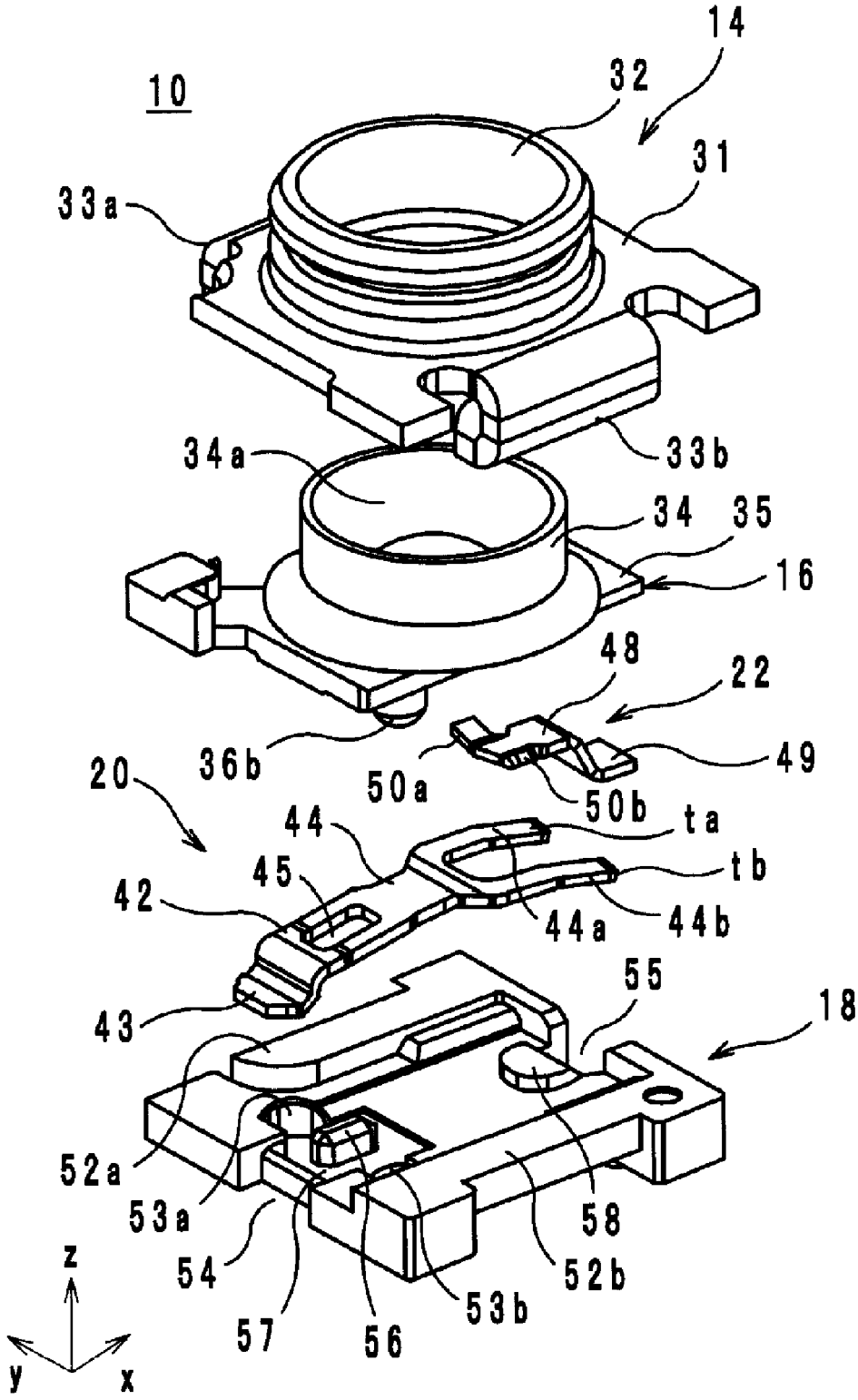
FIG. 2 is an exploded perspective view generally from the top of the coaxial connector shown in FIGS. 1A and 1B.
Figure 3:
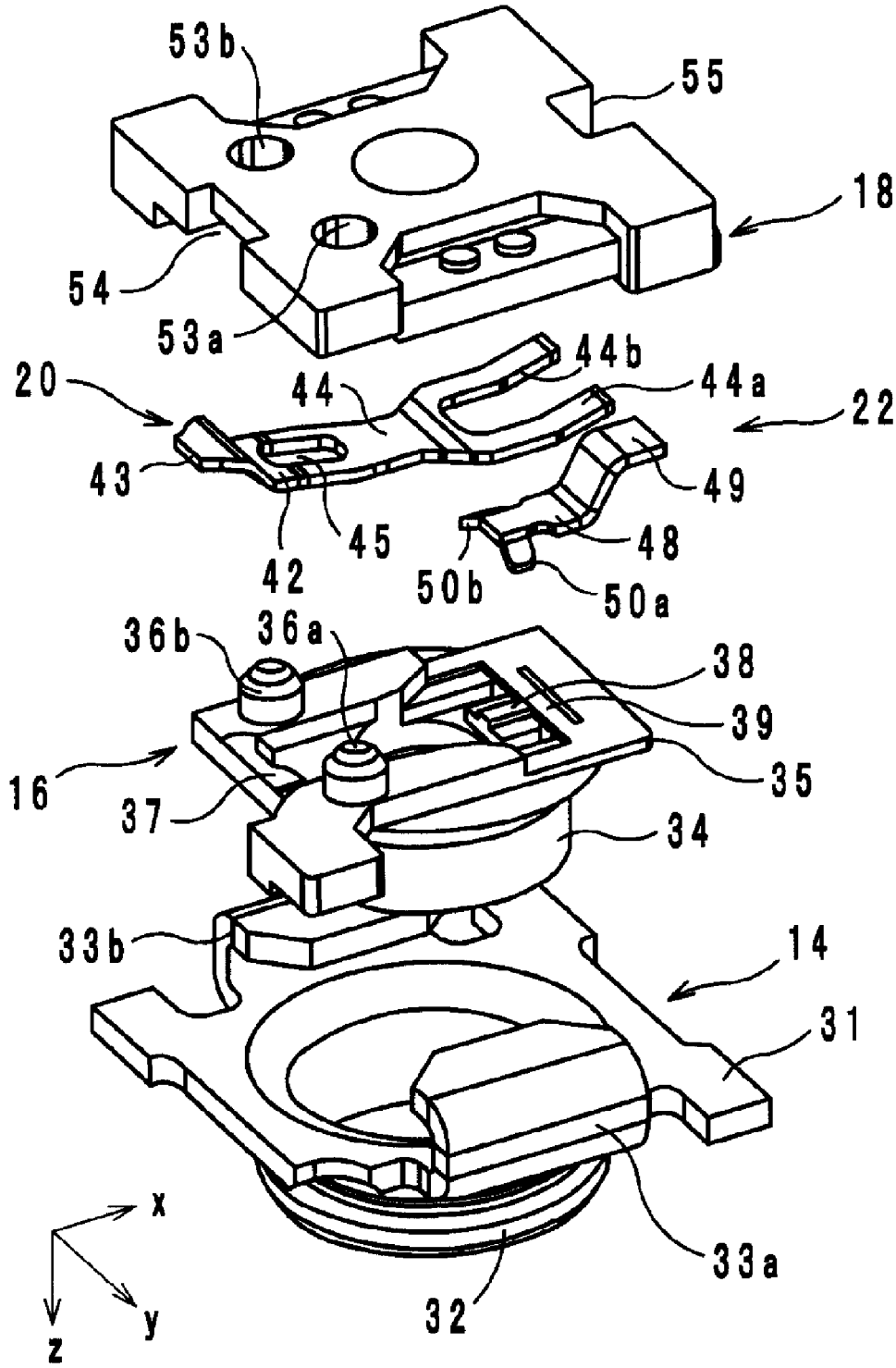
FIG. 3 is an exploded perspective view generally from the bottom of the coaxial connector shown in FIG. 1.

FIG. 1 is an external perspective view of a coaxial connector 10 according to an exemplary embodiment. FIGS. 2 and 3 are exploded perspective views of the coaxial connector 10. Details of the coaxial connector (coaxial receptacle) 10 are described below. In FIGS. 1 to 3, the z-direction is a direction in which an external terminal 14, an upper casing 16, and a lower casing 18 are placed. The positive z-direction is the direction extending from the lower casing 18 toward the external terminal 14. The x-direction is a direction in which a movable terminal 20 and a fixed terminal 22 are arranged. The y-direction is a direction perpendicular to the x-direction and the z-direction. The positive x-direction is a direction extending from the movable terminal 20 toward the fixed terminal 22.

As shown in FIG. 1, the coaxial connector 10 includes a main body 12, the movable terminal 20, and the fixed terminal 22. The movable terminal 20 and the fixed terminal 22 are made of a metal (for example, stainless steel SUS303). The coaxial connector 10 can have a size of 2 mm×2 mm×0.9 mm, for example. As shown in FIG. 2, the main body 12 is constructed such that the metallic external terminal 14, the resin upper casing 16 and lower casing 18 are placed in this order from the positive to negative z-direction.

As shown in FIG. 2, the lower casing 18 can be substantially rectangular and have projections 52*a* and 52*b* for positioning the upper casing 16 on the surface of lower casing 18 that faces the positive z-direction. The projections 52*a* and 52*b* are arranged along sides of the lower casing 18 at both ends in the y-direction and extend in the x-direction. The lower casing 18 has openings 53*a* and 53*b*.

In addition, as shown in FIG. 2, the lower casing 18 can have rectangular recesses 54 and 55 in the respective central parts of two sides extending in the y-direction. The recesses 54 and 55 are used in drawing out the movable terminal 20 and the fixed terminal 22, respectively. A projection 56 for positioning the movable terminal 20 is provided in the vicinity of the recess 54 in the positive x-direction from the recess 54. A fixing surface 57 for fixing the movable terminal 20 is provided between the recess 54 and the projection 56. A fixing surface 58 for fixing the fixed terminal 22 is provided in the vicinity of the recess 55 in the negative x-direction from the recess 55.

As shown in FIG. 2, the upper casing 16 includes a cylinder portion 34 and a cover 35. The cover 35 is a plate-like member that has an outer shape extending along the projections 52*a* and 52*b* and is fit into the gap between the projections 52*a* and 52*b*. The cylinder portion 34 protrudes to the positive z-direction at or near the center of the cover 35. The cylinder portion 34 can have a bowl shape that is open in the positive z-direction and have a hole, or opening 34*a* with a circular cross section in an xy plane. The opening 34*a* passes through the upper casing 16. The opening 34*a* allows a probe of a counterpart coaxial connector to be inserted therethrough from the bowl-shaped opening side.

In addition, as shown in FIG. 3, two cylinder ribs 36*a* and 36*b* protruding in the negative z-direction are provided on a surface of the upper casing 16 that faces the negative z-direction. The upper casing 16 and the lower casing 18 are positioned by the ribs 36*a* and 36*b* being inserted into the openings 53*a* and 53*b*, respectively, provided in the lower casing 18.

As shown in FIG. 3, a fixing surface 37 for fixing the movable terminal 20 in the vicinity of an end of the movable terminal 20 that faces the negative x-direction is provided on a surface of the upper casing 16 that faces the negative z-direction. The fixing surface 37 fixes the movable terminal 20 by sandwiching it with the fixing surface 57 when the coaxial connector 10 is assembled. Similarly, a fixing surface 39 for fixing the fixed terminal 22 in the vicinity of an end of the fixed terminal 22 that faces the positive x-direction is provided on the surface of the upper casing 16 that faces the negative z-direction. The fixing surface 39 fixes the fixed terminal 22 by sandwiching it with the fixing surface 58 when the coaxial connector 10 is assembled. In addition, a mounting portion 38 is provided on the upper casing 16 in the negative x-direction. The mounting portion 38 is provided on the surface of the upper casing 16 that faces the negative z-direction so as to protrude in the negative z-direction. A fixed portion 48 and contact portions 50*a* and 50*b* of the fixed terminal 22, which are described below, are mounted on the mounting portion 38.

Next, the movable terminal 20 and the fixed terminal 22 are described with reference to FIGS. 1 to 5. FIG. 4 is an external perspective view that shows a state where the movable terminal 20 and the fixed terminal 22 are attached on the lower casing 18. FIG. 5 is an external perspective view that shows a state where the movable terminal 20 and the fixed terminal 22 are attached on the upper casing 16.

The fixed terminal 22 can be formed by stamping and bending a flat metallic plate and can be made up of the fixed portion 48, a lead portion 49, and the contact portions 50*a* and 50*b*, as shown in FIGS. 2 and 3. The fixed portion 48 can be a flat portion fixed to the main body 12 by being sandwiched between the fixing surface 39 and the fixing surface 58 when the coaxial connector 10 is assembled. The lead portion 49 can be formed by bending of the fixed portion 48 into an L shape. As shown in FIGS. 1 and 4, the lead portion 49 is exposed through the recess 55 to the outside of the main body 12 when the coaxial connector 10 is assembled. As shown in FIGS. 4 and 5, the contact portions 50*a* and 50*b* can be formed by bending of the fixed portion 48 in the positive z-direction and are in contact with the movable terminal 20 at a section that faces the negative z-direction. The two contact portions 50*a* and 50*b* are provided so as to correspond to branches 44*a* and 44*b* of the movable terminal 20, which are described below. A bending line between the fixed portion 48 and each of the contact portions 50*a* and 50*b* is parallel with the x-direction. As shown in FIG. 5, the contact portions 50*a* and 50*b* and the fixed portion 48, which is provided between the contact portions 50*a* and 50*b*, are mounted on the mounting portion 38, which has a shape extending along the contact portions 50*a* and 50*b* and the fixed portion 48.

The movable terminal 20 can be formed by stamping of a springy metallic plate into a predetermined shape and bending it. As shown in FIGS. 2 and 3, the movable terminal 20 can include a fixed portion 42, a lead portion 43, and a plate spring portion 44. The fixed portion 42 is a flat section fixed to the main body 12 by being sandwiched between the fixing surface 37 and the fixing surface 57 when the coaxial connector 10 is assembled. The lead portion 43 can be formed by bending the fixed portion 42 into an L shape. As shown in FIGS. 1 and 4, the lead portion 43 is exposed through the recess 54 to the outside of the main body 12 when the coaxial connector 10 is assembled.

As shown in FIG. 4, the plate spring portion 44 linearly extends in the x-direction from the fixed portion 42 toward the fixed terminal 22, is in contact with the contact portions 50*a* and 50*b* of the fixed terminal 22, and is slidably in contact with the lower casing 18 at tips ta and tb thereof. More specifically, the plate spring portion 44 includes the branches 44*a* and 44*b* formed by branching into two parts at and adjacent to the tips ta and tb (the positive x-direction). The fixed terminal 22 is positioned between the branches 44*a* and 44*b*. The gap between the contact portions 50*a* and 50*b* of the fixed terminal 22 widens in the y-direction when going toward the positive z-direction such that portions or all of the contact portions 50*a* and 50*b* overlap the branches 44*a* and 44*b*, respectively, when being observed in plan view from the z-direction. The plate spring portion 44 is curved so as to protrude in, or bend toward the positive z-direction. Therefore, the branches 44*a* and 44*b* can be pressed in contact with the contact portions 50*a* and 50*b*, respectively, by an urging force of the plate spring portion 44. This electrically connects the movable terminal 20 and the fixed terminal 22.

In addition, an opening 45 lies across the border between the plate spring portion 44 and the fixed portion 42. As shown in FIG. 4, the projection 56 is inserted in the opening 45. This positions the movable terminal 20 in an xy plane.

For the movable terminal 20 and the fixed terminal 22 having the above structure, as shown in FIG. 5, the fixed terminal 22 can be first attached to the upper casing 16, and the movable terminal 20 can then be attached to the upper casing 16. This causes sections of the branches 44*a* and 44*b* in the positive z-direction and sections of the contact portions 50*a* and 50*b* in the negative z-direction to come into contact with each other.

The external terminal 14 comes into contact with an outer conductor of a counterpart coaxial connector and can be formed by stamping of a metallic plate of a stainless steel (for example, SUS301) and bending, drawing, or other process thereof. As shown in FIGS. 1 and 2, the external terminal 14 includes a flat portion 31, a cylinder portion 32, and legs 33*a* and 33*b*.

The flat portion 31 is a plate-like member and covers the upper casing 16 from the positive z-direction. The legs 33*a* and 33*b* are provided at sides at both ends of the flat portion 31 in the y-direction. Each of the legs 33*a* and 33*b* can be formed by bending of a part of a plate body extending in the y-direction from the flat portion 31. As shown in FIG. 1, the legs 33*a* and 33*b* fix the upper casing 16 and the lower casing 18 by sandwiching them. In addition, the cylinder portion 32 can be provided at the central part of the flat portion 31 so as to protrude in the positive z-direction. The cylinder portion 32 can be formed so as to share a center with the cylinder portion 34 and engages an outer conductor of a counterpart coaxial connector. The external terminal 14 typically functions as a ground. The outer surface of the external terminal 14 can be plated, if needed.

The coaxial connector 10 having the above structure can be assembled in a way described below. As shown in FIG. 5, the fixed terminal 22 is aligned and attached to the upper casing 16. After that, the movable terminal 20 is aligned and attached to the upper casing 16. While FIG. 5 shows the legs 33*a* and 33*b* as being bent, in actuality, at this stage, legs 33*a* and 33*b* are not yet bent.

Next, as shown in FIG. 5, the external terminal 14 is attached to the upper casing 16 from the positive z-direction. At this time, the cylinder portion 34 is inserted into the cylinder portion 32. After that, as shown in FIG. 3, the lower casing 18 is placed on the upper casing 16 from the negative z-direction. At this time, the ribs 36*a* and 36*b* are inserted into the openings 53*a* and 53*b*, respectively.

Finally, the legs 33*a* and 33*b* of the external terminal 14 are crimped. In such a way, the coaxial connector 10 having the structure shown in FIG. 1 is obtainable.

Figure 6A:
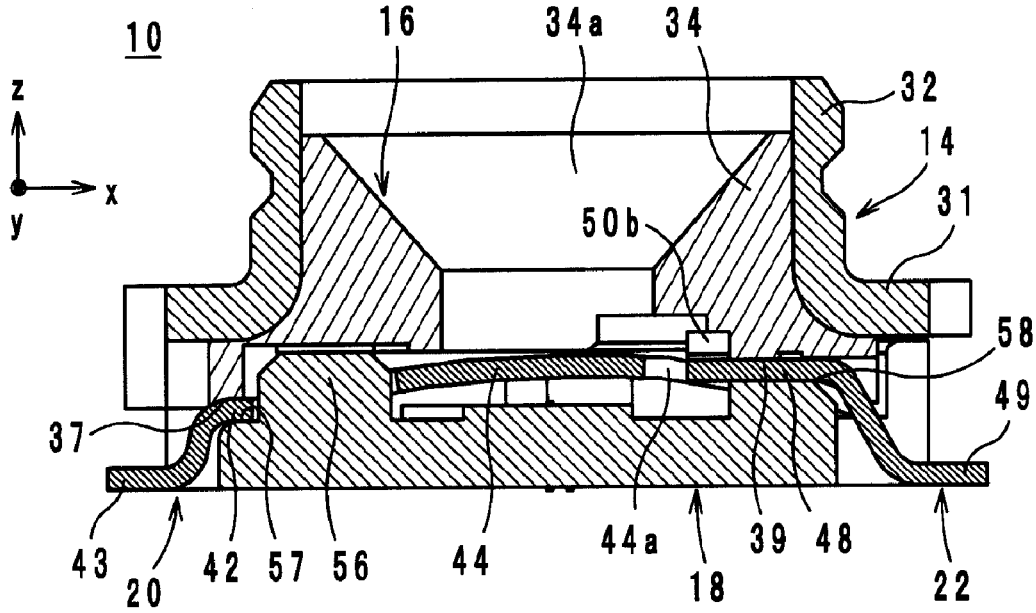
FIG. 6A is a cross-sectional structure of the coaxial connector shown in FIG. 1 in an xz plane when a counterpart coaxial connector is not attached.
Figure 6B:
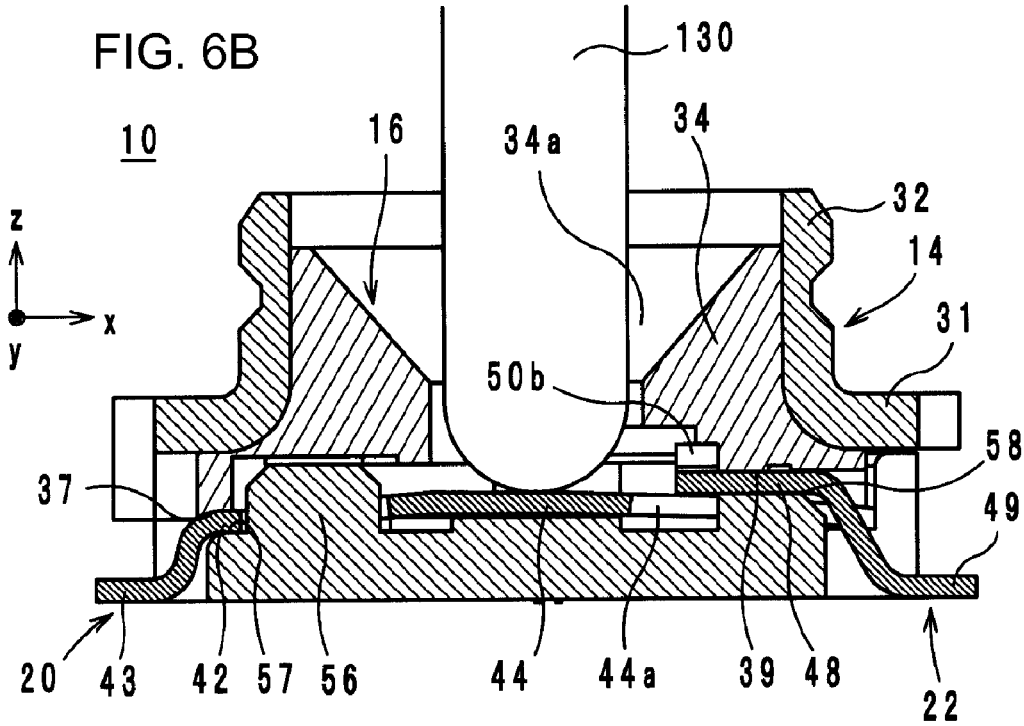
FIG. 6B is a cross-sectional structure of the coaxial connector shown in FIG. 1 in an xz plane when a counterpart coaxial connector is attached.

Next, operations of the coaxial connector 10 are described with reference to FIGS. 6A and 6B. FIG. 6A shows a cross-sectional structure of the coaxial connector 10 in an xz plane when a counterpart coaxial connector is not attached. FIG. 6B shows a cross-sectional structure of the coaxial connector 10 in an xz plane when a counterpart coaxial connector is attached.

As shown in FIG. 6A, when a counterpart coaxial connector is not attached, the movable terminal 20 is in a state where its central part in the x-direction bulges in the positive z-direction. This causes the branches 44*a* and 44*b* (in FIG. 6, only the branch 44*a* is shown) to be pressed in contact with the contact portions 50*a* and 50*b* (in FIG. 6, only the contact portion 50*a* is shown) by an urging force of the plate spring portion 44, and the movable terminal 20 and the fixed terminal 22 are electrically connected to each other.

In contrast, when a counterpart coaxial connector is attached, a probe 130 of the counterpart coaxial connector is inserted from the positive to negative z-direction through the opening 34*a*. This causes the probe 130 to come into contact with the plate spring portion 44 and to press the plate spring portion 44 downward toward the negative z-direction. That is, the plate spring portion 44 is displaced by the probe 130 in a direction away from the fixed terminal 22. This separates the branches 44*a* and 44*b* of the plate spring portion 44 from the contact portions 50*a* and 50*b*, respectively, breaks the electric connection of the movable terminal 20 and the fixed terminal 22, and electrically connects the probe 130 and the movable terminal 20, as shown in FIG. 6B. At the same time, the outer conductor (not shown) of the counterpart coaxial connector engages the external terminal 14, and the outer conductor also becomes electrically connected to the external terminal 14.

When the counterpart coaxial connector is detached from the coaxial connector 10, the central part of the plate spring portion 44 in the x-direction returns to the positive z-direction, as shown in FIG. 6A. This electrically connects the movable terminal 20 and the fixed terminal 22 again and breaks the electric connection of the probe 130 and the movable terminal 20.

Figure 11:
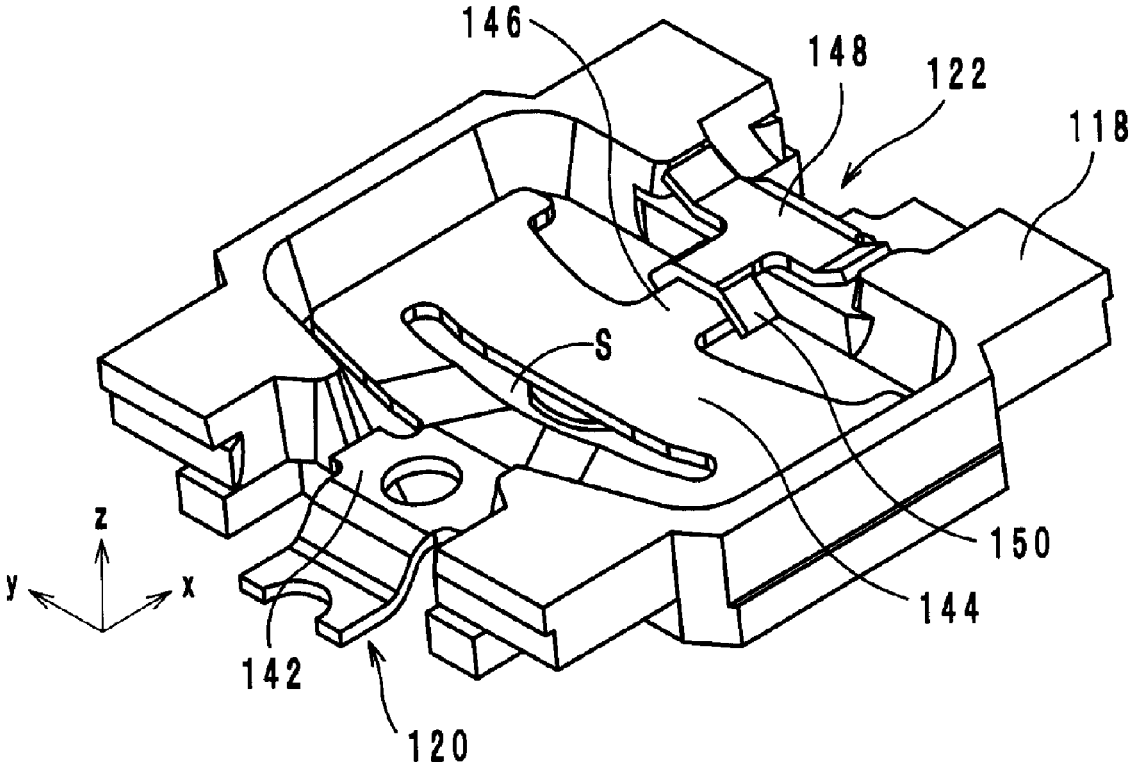
FIG. 11 Prior Art
FIG. 11 is an external perspective view that shows a casing, a movable terminal, and a fixed terminal of the conventional coaxial connector shown in FIG. 11.

The coaxial connector 10 having the above structure can achieve impedance matching more easily compared with the conventional coaxial connector 110 shown in FIG. 11. More specifically, for the coaxial connector 110 shown in FIG. 11, the direction in which the plate spring portion 144 extends and the direction of the signal path are perpendicular to each other, so the width of the signal path significantly varies midway. Because of this, impedance matching in the coaxial connector 110 is undone.

In contrast, for the coaxial connector 10, as shown in FIG. 4, the plate spring portion 44 linearly extends from the fixed portion 42 toward the fixed terminal 22 and is electrically connected to the fixed terminal 22. This causes the direction in which the plate spring portion 44 extends and the signal path joining the movable terminal 20 and the fixed terminal 22 to coincide with each other. Here, the plate spring portion 44 needs a sufficient length to obtain an appropriate elastic force, whereas the plate spring portion 44 does not need as much width as the length of the plate spring portion 44. Accordingly, it is possible to set the width of the plate spring portion 44 at a value near to the width of the fixed terminal 22 or to the width of the other sections of the movable terminal 20 and achieve impedance matching. As a result, the coaxial connector 10 having a good radio-frequency characteristic is obtainable.

The coaxial connector 10 can have a smaller size compared with the coaxial connector 110 shown in FIG. 11. More specifically, for the coaxial connector 110 shown in FIG. 11, the direction in which the plate spring portion 144 extends and the direction of the signal path are perpendicular to each other. Because of this, the coaxial connector 110 needs a width that is at least no less than the length of the plate spring portion 144 in the y-direction. In contrast, embodiments of the coaxial connector 10 shown in FIG. 4 can include a plate spring portion 44 that extends from the fixed portion 42 toward the fixed terminal 22 and is electrically connected to the fixed terminal 22. This causes the direction in which the plate spring portion 44 extends, and the direction of the signal path joining the movable terminal 20 and the fixed terminal 22, to coincide with each other. As a result, the width of the coaxial connector 10 in the y-direction can be smaller than the width of the coaxial connector 110 in the y-direction, so the coaxial connector 10 can have a smaller size.

For the coaxial connector 110 shown in FIG. 11, the direction in which the plate spring portion 144 extends, and the direction of the signal path joining the movable terminal 120 and the fixed terminal 122, are perpendicular to each other. Thus, in order to connect the fixing portion 142 and the plate spring portion 144, it is necessary to branch the fixing portion 142, connect the branches to both ends of the plate spring portion 144. Also, in order to facilitate movement of the plate spring portion 144, it is necessary to have a slit S between the plate spring portion 144 and the fixing portion 142. Because of this, the size of the coaxial connector 110 is increased by the amount corresponding to the routing of the fixing portion 142 and the slit S.

In contrast, for the coaxial connector 10, as shown in FIG. 4, the direction in which the plate spring portion 44 extends and the direction of the signal path joining the movable terminal 20 and the fixed terminal 22 coincide with each other. In this case, the plate spring portion 44 can be operated merely by fixing only one end (i.e., the fixed portion 42) of the plate spring portion 44. Accordingly, it is not necessary for the coaxial connector 10 to route the fixed portion 42 and have a slit S, such as in the conventional coaxial connector 110. As a result, the size of the coaxial connector 10 can be reduced relative to the conventional coaxial connector 110.

Figure 10A:
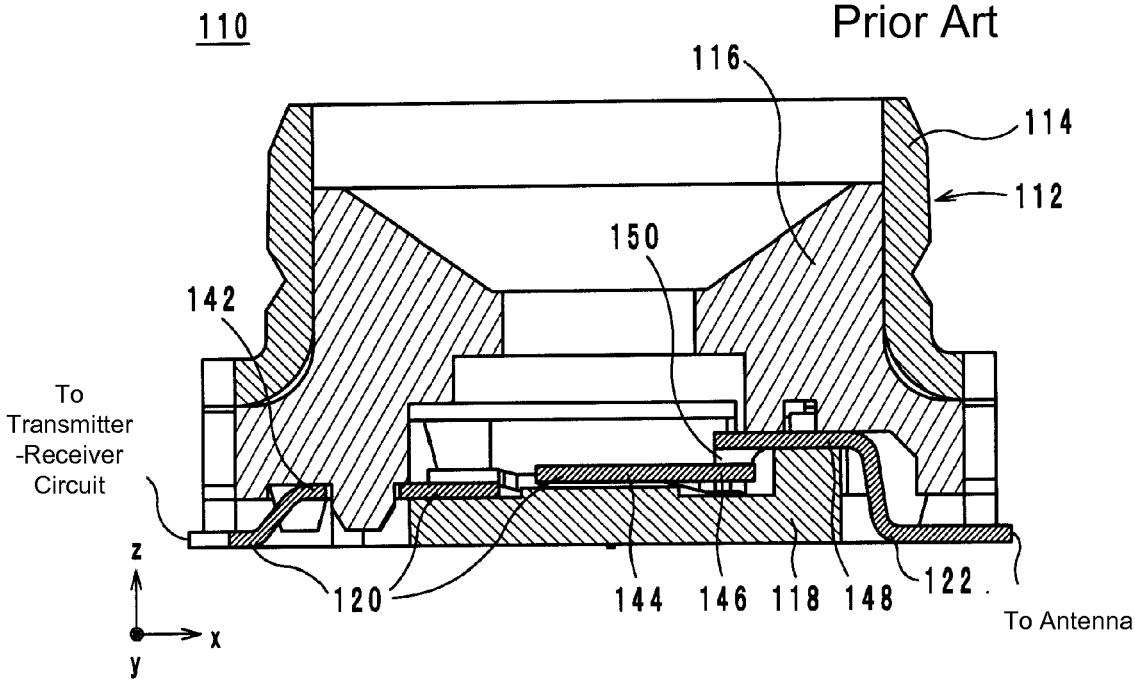
FIG. 10A Prior Art
FIG. 10A is a cross-sectional view of a conventional coaxial connector.
Figure 10B:
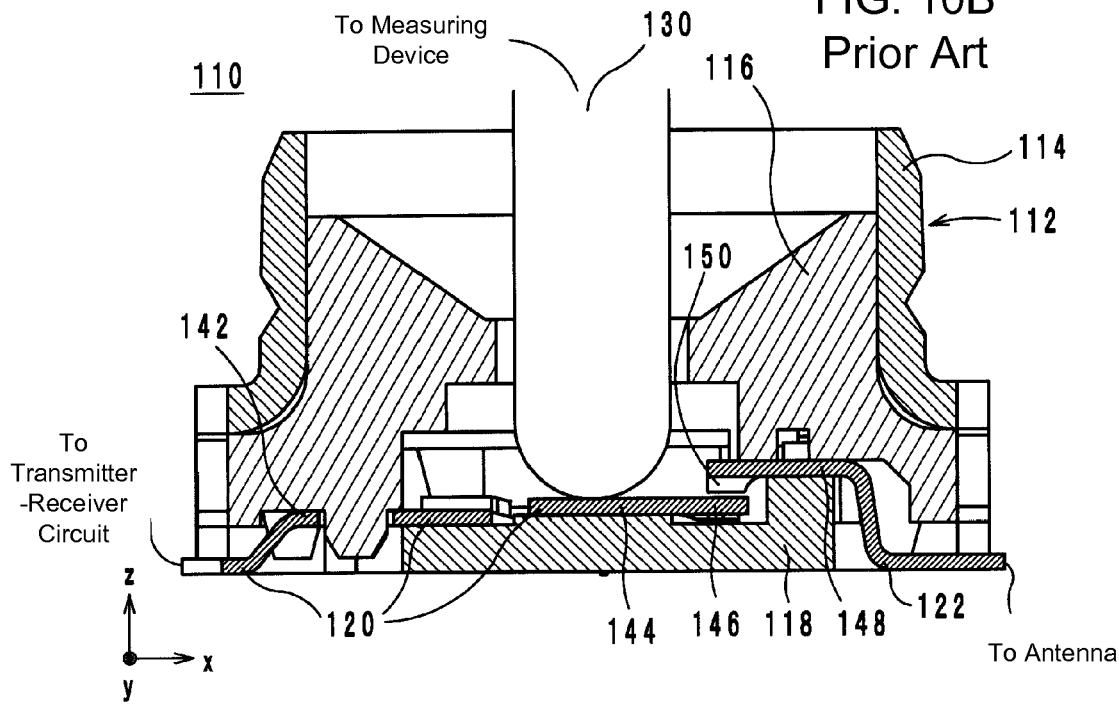
FIG. 10B Prior Art
FIG. 10B is a cross-sectional view of the conventional coaxial connector shown in FIG. 10A with a probe of a measuring device is attached.

The coaxial connector 10 can have a reduced profile compared with the coaxial connector 110, as will now be described. More specifically, for the coaxial connector 110, as shown in FIG. 10, the fixing portion 148 is positioned in the positive z-direction with respect to the movable terminal 120, and the contact portion 150 is bent from the fixing portion 148 toward the negative z-direction. The contact portion 150 is in contact with the movable terminal 120 at a surface that faces the negative z-direction. Accordingly, for the coaxial connector 110, a surface of the fixing portion 148 of the fixed terminal 122 that faces the positive z-direction is positioned higher than a surface of the movable terminal 120 that faces the positive z-direction by the amount corresponding to the thickness of the contact portion 150 and the thickness of the fixing portion 148. With a sample of the coaxial connector 110 produced in accordance with the invention, the distance from the bottom to the uppermost surface of the movable terminal 120 or the fixed terminal 122 is 0.35 mm.

In contrast, for the coaxial connector 10, as shown in FIG. 4, the fixed terminal 22 is positioned between the branches 44*a* and 44*b*. The contact portions 50*a* and 50*b*, which are formed by bending of the fixed portion 48 of the fixed terminal 22 in the positive z-direction are in contact with the branches 44*a* and 44*b*, respectively. Because of this, as shown in FIG. 6A, the plate spring portion 44 and the fixed portion 48 can be positioned at substantially the same height in the z-direction. In the present embodiment, a surface of the fixed portion 48 that faces the positive z-direction is positioned slightly lower than a surface of the plate spring portion 44 that faces the positive z-direction. Therefore, for the coaxial connector 10, the thickness of the fixed terminal 22 is reduced by the amount corresponding to the thickness of the contact portion 150 and the thickness of the fixing portion 148 of the conventional coaxial connector 110. Accordingly, the coaxial connector 10 can have a reduced profile, as compared with the coaxial connector 110. With a sample of the coaxial connector 10 produced in accordance with the invention, the distance from the bottom to the surface of the fixed portion 48 of the fixed terminal 22 that faces the positive z-direction is 0.28 mm.

For the coaxial connector 10, as shown in FIG. 4, the fixed terminal 22 is positioned between the branches 44*a* and 44*b*. That is, the tips ta and tb of the plate spring portion 44 and the fixed terminal 22 are arranged along the y-direction. Because of this, even if each of the branches 44*a* and 44*b* has a longer length, there is no possibility that the tips ta and tb of the branches 44*a* and 44*b* come into contact with the fixed terminal 22. Therefore, each of the branches 44*a* and 44*b* can have a sufficiently long length, and the plate spring portion 44 having an appropriate elastic force can be easily provided. In addition, because a sufficient distance from the tips ta and tb of the branches 44*a* and 44*b* to the fixed terminal 22 is ensured, the contact between the tips ta and tb and the fixed terminal 22 can be avoided, and sufficient isolation between the movable terminal 20 and the fixed terminal 22 can be ensured.

For the coaxial connector 10, as shown in FIG. 4, the branch 44*a* is in contact with the contact portion 50*a*, and the branch 44*b* is in contact with the contact portion 50*b*. That is, the movable terminal 20 and the fixed terminal 22 are in contact with each other at two locations. Because of this, with the coaxial connector 10, the movable terminal 20 and the fixed terminal 22 can be connected more reliably, as compared with when the movable terminal and the fixed terminal are in contact with each other at only one location.

For the coaxial connector 10, as described below, the contact portions 50*a* and 50*b* are in contact with the branches 44*a* and 44*b*, respectively, at a line or point. Therefore, with the coaxial connector 10, stable resistance is obtainable. More specifically, the surface of each of the contact portions 50*a* and 50*b* and the branches 44*a* and 44*b* has roughness to some extent. Because of this, if the contact portions 50*a* and 50*b* were to be in contact with the branches 44*a* and 44*b*, respectively, through their surfaces, the contact portions 50*a* and 50*b* will be in contact with the branches 44*a* and 44*b*, respectively, at many points in their surfaces being in contact with each other. Accordingly, depending on the roughness of their surfaces, the number of the many points will vary, so the contact area between the contact portion 50*a* and the branches 44*a* and that between the contact portion 50*b* and the branch 44*b* will vary significantly. As a result, the resistance of the coaxial connector 10 will significantly vary.

In contrast, for the coaxial connector 10, as shown in FIG. 4, the contact portions 50*a* and 50*b* are inclined in an oblique direction with respect to the z-direction. Because of this, the contact portions 50*a* and 50*b* are in contact with ridge lines of the branches 44*a* and 44*b*, respectively. As a result, the contact portions 50*a* and 50*b* are in contact with the branches 44*a* and 44*b*, respectively, at a point or line. In such a manner, when the contact portions 50*a* and 50*b* are in contact with the branches 44*a* and 44*b*, respectively, at a point or line, the contact area between the contact portion 50*a* and the branches 44*a* and that between the contact portion 50*b* and the branch

44*b* are stable, irrespective of the surface roughness of each of the contact portions 50*a* and 50*b* and the branches 44*a* and 44*b*. In addition, when the contact portions 50*a* and 50*b* are in contact with the branches 44*a* and 44*b*, respectively, at a point or line, a large pressure is focused on the point or line. As a result, the contact portions 50*a* and 50*b* are strongly connected to the branches 44*a* and 44*b*, respectively, so the contact area between the contact portion 50*a* and the branch 44*a* and that between the contact portion 50*b* and the branch 44*b* are stable. As described above, making the contact portions 50*a* and 50*b* be in contact with the branches 44*a* and 44*b*, respectively, at a point or line can reduce variations in the resistance of the coaxial connector 10.

In particular, it is preferable that the contact portions 50*a* and 50*b* be in contact with the branches 44*a* and 44*b*, respectively, at a point, because the number of contacts is small. To make the contact portions 50*a* and 50*b* be in contact with the branches 44*a* and 44*b*, respectively, at a point, as indicated by the point P shown in FIG. 4, they can be in contact while ridge lines of the contact portions 50*a* and 50*b* intersect ridge lines of the branches 44*a* and 44*b*, respectively.

For the coaxial connector 10, a first end of the plate spring portion 44 is fixed by the fixed portion 48, whereas a second end of the plate spring portion 44 is slidably in contact with the lower casing 18. Accordingly, the plate spring portion 44 forms a both side supporting spring. The plate spring portion 44 forming a both side supporting spring can reduce the occurrence of plastic deformation of the plate spring portion 44 caused by the probe 130 pressing it down too much. As a result, reliability of the coaxial connector 10 is improved.

Figure 1B:
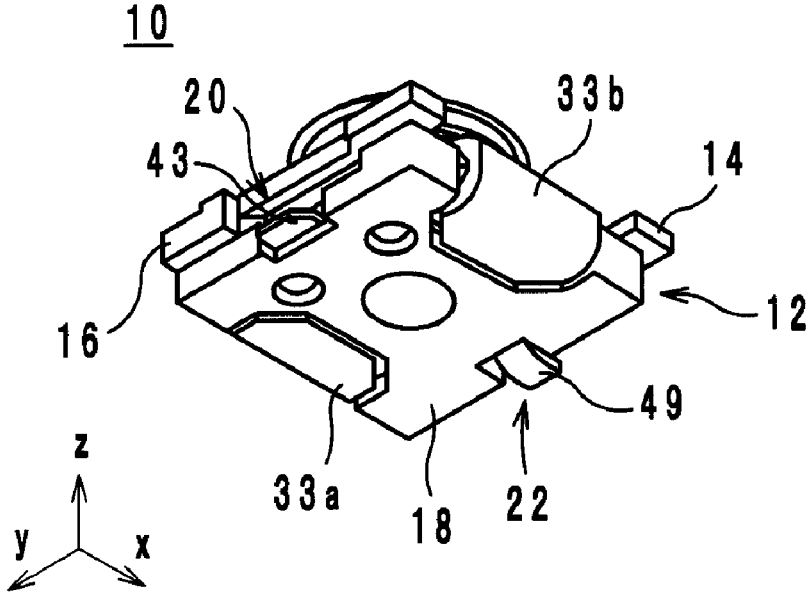
FIG. 1B is an external perspective view generally from the bottom of a coaxial connector according to an exemplary embodiment.

For the coaxial connector 10, as shown in FIG. 1B, the lead portions 43 and 49 and the legs 33*a* and 33*b* are substantially flush with the bottom of the lower casing 18, and the coaxial connector 10 has a structure that can be surface-mounted. Also, the external terminal 14 includes the cylinder portion 32, so stable and reliable connection with a counterpart coaxial connector is obtainable.

The coaxial connector 10 is not limited to the one shown in the above embodiment and can be modified within the scope thereof. For example, FIG. 7 is an external perspective view showing a lower casing 18 according an exemplary embodiment that is modified relative to the embodiment shown in FIGS. 1-6.

Figure 7:
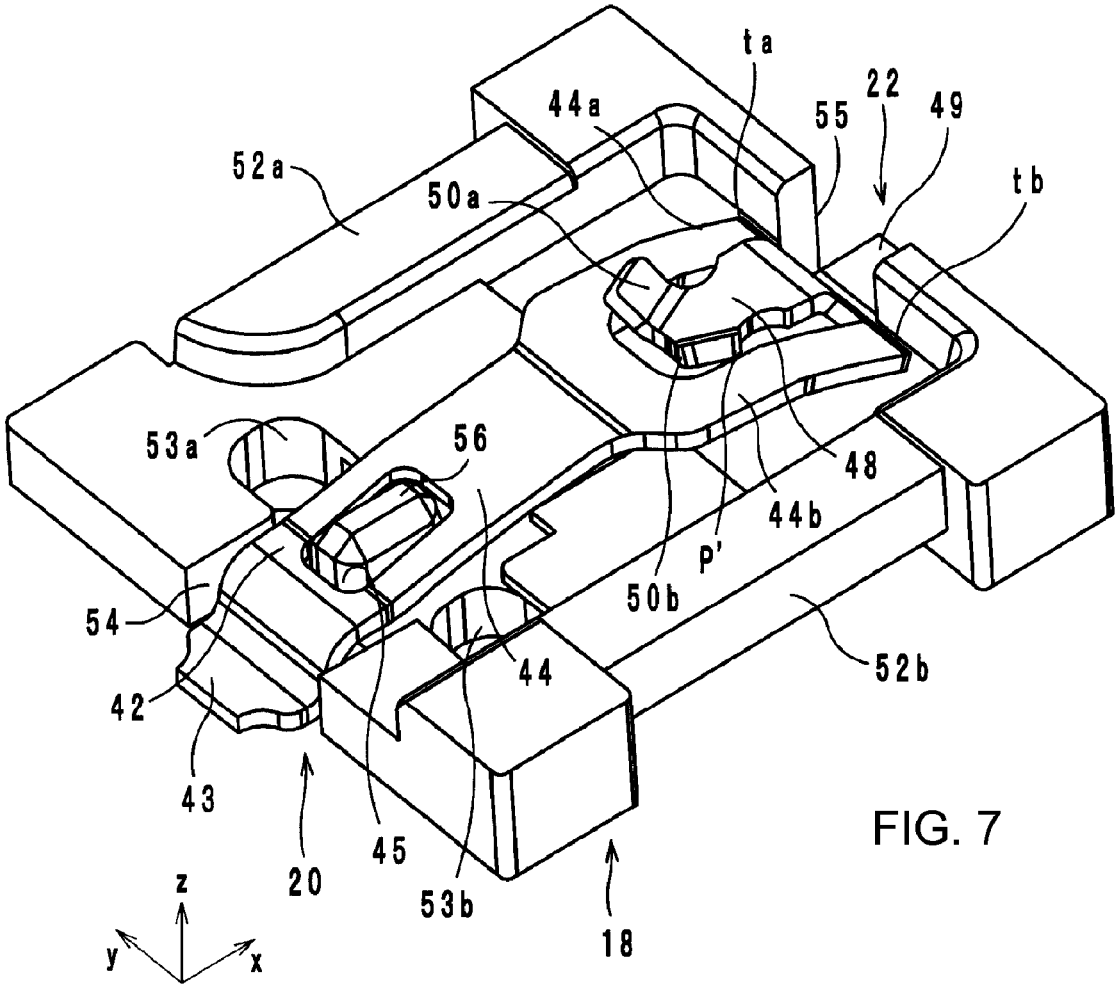
FIG. 7 is an external perspective view generally from the top that shows a state in which a movable terminal and a fixed terminal are attached on a lower casing in a coaxial connector according to an exemplary embodiment.

With reference to FIG. 7, a movable terminal 20 and the fixed terminal 22 are attached on the lower casing 18. As shown in FIG. 7, the bending line between the fixed portion 48 and each of the contact portions 50*a* and 50*b* may not be parallel with the x-axis. However, as described below, it is preferable that the bending line between the fixed portion 48 and each of the contact portions 50*a* and 50*b* be parallel with the x-axis, as shown in FIG. 4, in terms of reliability of the coaxial connectors 10 and 10*a*.

More specifically, as shown in FIG. 7, when the fixed portion 48 has a narrowed tip, the bending line between the fixed portion 48 and each of the contact portions 50*a* and 50*b* is not parallel with the x-axis. In this case, the contact portions 50*a* and 50*b* are in contact with the branches 44*a* and 44*b*, respectively, at a point P'.

In contrast, as shown in FIG. 4, when the bending line between the fixed portion 48 and each of the contact portions 50*a* and 50*b* is parallel with the x-axis, the contact portions 50*a* and 50*b* are in contact with the branches 44*a* and 44*b*, respectively, at the point P, which is positioned in the negative x-direction with respect to the point P'. Because the point P is positioned in the negative x-direction with respect to the point P', the point P is adjacent to the vertex (the central part in the x-direction) of the plate spring portion 44. In this case, as described below, even when the plate spring portion 44 is used for a long time and is becoming deformed, the contact portions 50*a* and 50*b* and the branches 44*a* and 44*b* are less prone to being separated from each other.

Figure 8:
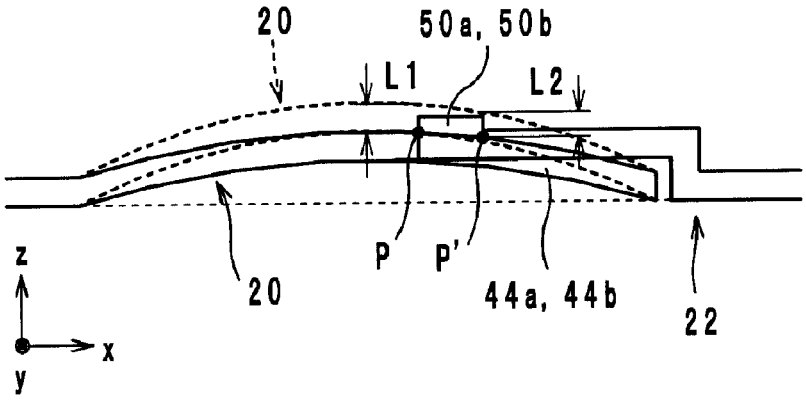
FIG. 8 is a diagram showing a movable terminal and a fixed terminal of a coaxial connector according to an exemplary embodiment.

FIG. 8 shows the movable terminal 20 and the fixed terminal 22 of FIG. 7. As shown in FIG. 8, the movable terminal 20 is pressed in contact with the fixed terminal 22. In other words, the movable terminal 20 is pressed toward the negative z-direction by the contact portions 50*a* and 50*b* of the fixed terminal 22. Accordingly, if the fixed terminal 22 does not exist, the movable terminal 20 will take a shape further protruding toward the positive z-direction, as indicated by the dotted line shown in FIG. 8.

Here, FIG. 8 reveals that the difference between the movable terminal 20 indicated by the dotted line and the movable terminal 20 indicated by the solid line increases as it approaches the central part of the movable terminal 20 in the x-direction. Accordingly, when the contact portions 50*a* and 50*b* are in contact with the branches 44*a* and 44*b*, respectively, at the point P, the fixed terminal 22 presses the movable terminal 20 by a longer distance L1. In contrast, when the contact portions 50*a* and 50*b* are in contact with the branches 44*a* and 44*b*, respectively, at the point P', the fixed terminal 22 presses the movable terminal 20 by a shorter distance L2. Accordingly, when the contact portions 50*a* and 50*b* are in contact with the branches 44*a* and 44*b*, respectively, at the point P, the distance by which the movable terminal 20 is pressed is longer than that when the contact portions 50*a* and 50*b* are in contact with the branches 44*a* and 44*b*, respectively, at the point P'.

If the movable terminal 20 is used repeatedly or the inserted state continues for a long time, the movable terminal 20 is subjected to plastic deformation or the like, and the movable terminal 20 is gradually lowered in the negative z-direction. When the contact portions 50*a* and 50*b* are in contact with the branches 44*a* and 44*b*, respectively, at the point P, the contact between the movable terminal 20 and the fixed terminal 22 is maintained until the movable terminal 20 is lowered by the distance L1 at the point P. In contrast, when the contact portions 50*a* and 50*b* are in contact with the branches 44*a* and 44*b*, respectively, at the point P', the contact between the movable terminal 20 and the fixed terminal 22 is broken merely by the movable terminal 20 being lowered by the distance L2. Accordingly, in the case where the contact portions 50*a* and 50*b* are in contact with the branches 44*a* and 44*b*, respectively, at the point P, the movable terminal 20 and the fixed terminal 22 are less prone to being detached by repeated use or long-time continuous inserted state, as compared with the case where they are in contact with each other at the point P'. As described above, as in the coaxial connector 10 shown in FIG. 4, parallelism of the bending line between the fixed portion 48 and each of the contact portions 50*a* and 50*b* with the x-axis can improve reliability of the coaxial connector 10.

Figure 9:
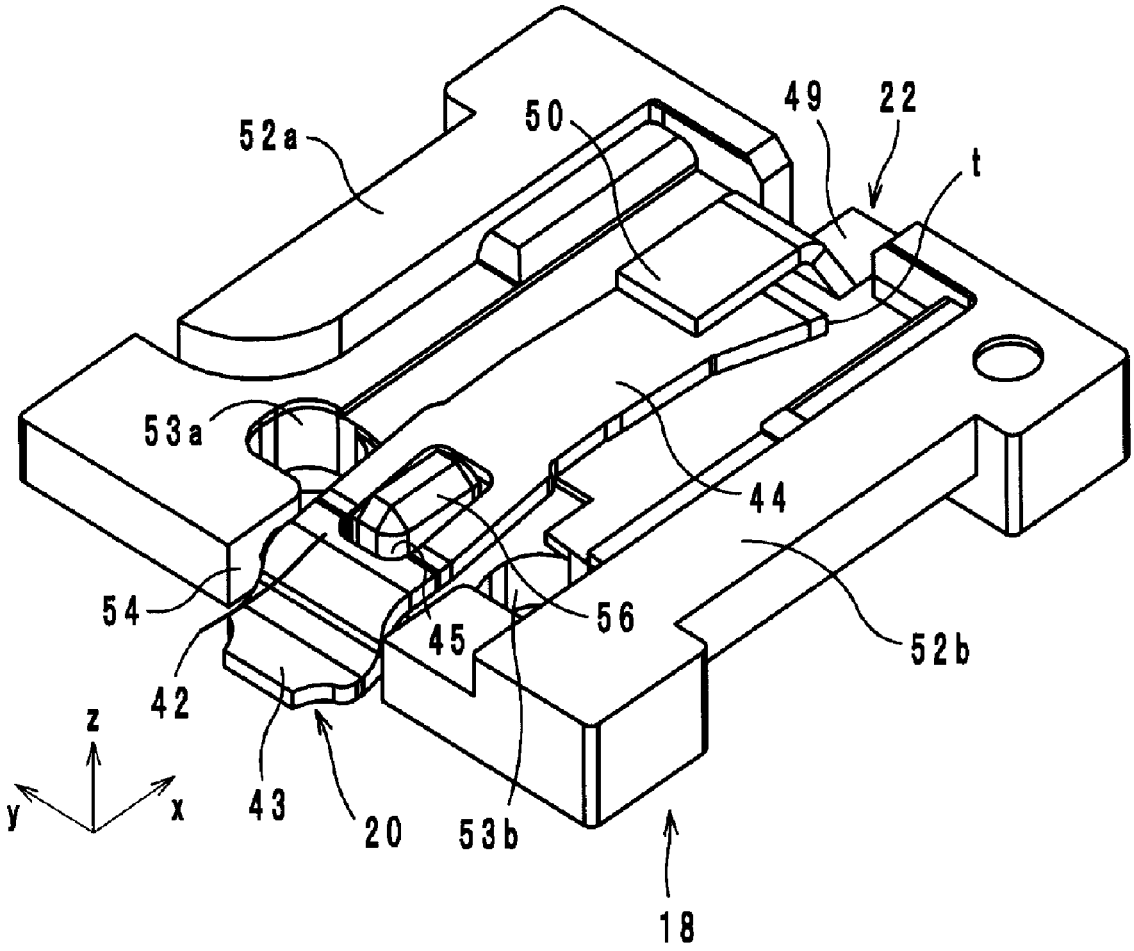
FIG. 9 is an external perspective view generally from the top side that shows a state in which a movable terminal and a fixed terminal are attached on a lower casing in a coaxial connector according to a second modification example.

For the coaxial connector 10 shown in FIG. 4, the movable terminal 20 includes the branches 44*a* and 44*b*. However, it is not necessary for the movable terminal 20 to have branches. FIG. 9 is an external perspective view of an exemplary embodiment that shows a state in which the movable terminal 20 and the fixed terminal 22 are attached on the lower casing 18 of an exemplary coaxial connector according to another modification.

In the embodiment shown in FIG. 9, the movable terminal 20 extends from the fixed portion 42 toward the fixed terminal 22 in a single-line state without branching. A tip t of the movable terminal 20 is introduced in the gap between the fixed terminal 22 and the lower casing 18. Even with such a structure, similar to the coaxial connector 10, impedance matching can be achieved, while at the same time the size can be reduced.

In terms of isolation between the movable terminal 20 and the fixed terminal 22, the coaxial connector 10 shown in FIG. 4 has the advantage over the coaxial connector 10*b* shown in FIG. 9. More specifically, for the coaxial connector 10*b* shown in FIG. 9, the tip t of the movable terminal 20 is introduced in the gap between the fixed terminal 22 and the lower casing 18. Because of this, when the plate spring portion 44 is pressed by the probe 130, the distance between the tip t and the fixed terminal 22 is significantly small. Accordingly, there may be cases where sufficient isolation between the movable terminal 20 and the fixed terminal 22 cannot be ensured.

In contrast, for the coaxial connector 10 shown in FIG. 4, because the tips ta and tb are not introduced in the gap between the fixed terminal 22 and the lower casing 18, there is no possibility that the tips ta and tb come into contact with the fixed terminal 22. Accordingly, the coaxial connector 10 has the advantage over the coaxial connector 10*b* in the isolation between the movable terminal 20 and the fixed terminal 22.

As described above, the present invention is useful in a coaxial connector and, in particular, advantageous in that impedance matching in the coaxial connector can be easily achieved and the coaxial connector having a good radio-frequency characteristic is obtainable.

Although a limited number of embodiments are described herein, one of ordinary skill in the art will readily recognize that there could be variations to any of these embodiments and those variations would be within the scope of the appended claims. Thus, it will be apparent to those skilled in the art that various changes and modifications can be made to the coaxial connector device described herein without departing from the scope of the appended claims and their equivalents.

What is claimed is:

1. A coaxial connector, comprising:

a main body that has a hole allowing a probe to be inserted therein;

a fixed terminal fixed to the main body; and a movable terminal including a portion fixed to the main body and a plate spring portion, said plate spring portion having a length in a direction in which the movable terminal and the fixed terminal are aligned and linearly extending in said direction from the fixed portion toward the fixed terminal, the plate spring portion being in contact with the fixed terminal and simultaneously in contact with the main body at a tip thereof, wherein when a probe is inserted into the hole in a downward direction, the plate spring portion is curved in such a manner that a center region of the plate spring portion protrudes upward, the plate spring portion is urged upwards on the fixed terminal, and the plate spring portion is displaced by the inserted probe in said direction in which the movable terminal and the fixed terminal are aligned and in said downward direction away from the fixed terminal.

2. The coaxial connector according to claim 1, wherein two tips of the plate spring portion are arranged in a direction perpendicular to a direction in which the fixed terminal and the plate spring portion extend.

3. The coaxial connector according to claim 1, wherein a contact between the fixed terminal and the plate spring portion forms a line or point.

4. The coaxial connector according to claim 1, wherein the fixed terminal includes:

a fixed-terminal fixed portion fixed to the main body; and at least one contact portion, wherein, when the probe is inserted in the downward direction, the at least one contact portion is a portion of the fixed-terminal fixed portion bent upward and is in contact with the plate spring portion at a section of the bent portion that faces the downward direction.

5. The coaxial connector according to claim 4, wherein two tips of the plate spring portion are arranged in a direction perpendicular to a direction in which the fixed terminal and the plate spring portion extend.

6. The coaxial connector according to claim 4, wherein a contact between the fixed terminal and the plate spring portion forms a line or point.

7. The coaxial connector according to claim 4, wherein, when the direction in which the probe is inserted is the downward direction, the fixed-terminal fixed portion is positioned lower than a region where the at least one contact portion and the plate spring portion are in contact with each other.

8. The coaxial connector according to claim 7, wherein two tips of the plate spring portion are arranged in a direction perpendicular to a direction in which the fixed terminal and the plate spring portion extend.

9. The coaxial connector according to claim 7, wherein a contact between the fixed terminal and the plate spring portion forms a line or point.

10. The coaxial connector according to claim 4, wherein a bending line between the at least one contact portion and the fixed-terminal fixed portion is parallel with a direction in which the plate spring portion extends.

11. The coaxial connector according to claim 7, wherein a bending line between the at least one contact portion and the fixed-terminal fixed portion is parallel with a direction in which the plate spring portion extends.

12. The coaxial connector according to claim 4, wherein the plate spring portion includes two branches formed by branching into two parts at and adjacent to the tip, and the fixed terminal is positioned between the two branches.

13. The coaxial connector according to claim 12, wherein the at least one contact portion comprises two contact portions disposed so as to correspond to the two respective branches.

14. The coaxial connector according to claim 7, wherein the plate spring portion includes two branches formed by branching into two parts at and adjacent to the tip, and the fixed terminal is positioned between the two branches.

15. The coaxial connector according to claim 14, wherein the at least one contact portion comprises two contact portions disposed so as to correspond to the two respective branches.

16. The coaxial connector according to claim 10, wherein the plate spring portion includes two branches formed by branching into two parts at and adjacent to the tip, and the fixed terminal is positioned between the two branches.

17. The coaxial connector according to claim 16, wherein the at least one contact portion comprises two contact portions disposed so as to correspond to the two respective branches.

18. The coaxial connector according to claim 11, wherein the plate spring portion includes two branches formed by branching into two parts at and adjacent to the tip, and the fixed terminal is positioned between the two branches.

19. The coaxial connector according to claim 18, wherein the at least one contact portion comprises two contact portions disposed so as to correspond to the two respective branches.

* * * * *